US006041630A

United States Patent [19]

Shen

[11] Patent Number: 6,041,630

[45] Date of Patent: Mar. 28, 2000

[54] CLUTCH MECHANISM FOR A LOCK

[76] Inventor: Mu-Lin Shen, No. 32, Lane 76, Sec. 5, Fuan Rd., Tainan, Taiwan

[21] Appl. No.: 09/267,969

[22] Filed: Mar. 12, 1999

[51] Int. Cl.[7] ..... E05B 13/10

[52] U.S. Cl. ..... 70/472; 70/149; 70/223; 70/224

[58] Field of Search ..... 70/149, 218, 221–224, 70/422, 472; 292/DIG. 27

[56] References Cited

U.S. PATENT DOCUMENTS

| | | | |
|---|---|---|---|
| 655,605 | 8/1900 | Churchill | 70/149 |
| 1,143,610 | 6/1915 | Carr | 292/DIG. 27 X |
| 2,497,328 | 2/1950 | Smith et al. | 70/149 |
| 4,424,691 | 1/1984 | Foshee | 70/224 |
| 5,598,726 | 2/1997 | Cordle | 70/224 |
| 5,868,018 | 2/1999 | Kang | 70/224 X |

FOREIGN PATENT DOCUMENTS

| | | | |
|---|---|---|---|
| 397533 | 7/1910 | France | 70/149 |

*Primary Examiner*—Lloyd A. Gall

*Attorney, Agent, or Firm*—Holland & Hart LLP

[57] ABSTRACT

A lock includes an inner handle having a locking bar received therein and an outer handle connected to a spindle with a retaining base received therein which has two first grooves defined therein. A cam is connected to the retaining base and has two second grooves which communicate with the first grooves so that a locking piece is movably received between the retaining base and the cam with a spring biased between the locking piece and the retaining base. The locking piece has two flanges movably received in the first grooves and the second grooves. A slide is movably received in the cam and contact the locking piece at one end thereof and the locking bar at the other end thereof so that the two flanges of the locking piece are disengaged from the second grooves when the locking bar is pushed. Therefore, the outer handle can be freely rotated.

7 Claims, 6 Drawing Sheets

CLUTCH MECHANISM FOR A LOCK

FIELD OF THE INVENTION

The present invention relates to a lock, and more particularly, to an improved lock having a clutch mechanism which allows the outer handle to rotate when the lock is in the locked position so that the internal parts of the lock will not be damaged.

BACKGROUND OF THE INVENTION

A conventional door lock generally has an outer handle and an inner handle respectively and rotatably connected to the outside and the inside of the door so that the latch bolt can be retracted into the retractor of the lock by rotating either of the inner handle and the outer handle. When the lock is in a locked position, the outer handle cannot be rotated to retract the latch bolt. Nevertheless, people generally directly rotate the outer handle unintentionally even if the lock is locked so that the outer handle often incurs undesired torque. It is to be noted that when the lock is in a locked position, the outer handle is connected to the inner parts so that if the a large torque is applied to the outer handle, the related inner parts of the lock could be damaged.

The present invention intends to provide a lock which has a clutch mechanism which disengages the locking piece from the retaining base connected to the outer handle when the locking bar is pushed so that the outer handle is free to be rotated without actuating other parts in the lock. The clutch mechanism of the present invention involves a simple structure and resolves the inherent shortcomings of the conventional locks.

SUMMARY OF THE INVENTION

In accordance with one aspect of the present invention, there is provided a lock comprising an outer handle connected to a first spindle in which tumbler cylinder and a retaining base are respectively received therein. The retaining base has two first lugs extending from one of two ends thereof so as to define two first grooves between the two first lugs. A cam has two second lugs extending from one of two ends thereof so as to contact the two first lugs, two second grooves respectively defined between the two second lugs and communicating with the two first grooves. A slide is movably received in the cam and contacts a locking piece which is biasedly received between the first lugs and the second lugs. The locking piece has two flanges extending therefrom which are movably received in the first grooves and the second grooves.

An inner handle has a second spindle connected thereto through which a locking bar movably extends. A retractor is connected to the second spindle and is mounted to the locking bar which has a protrusion contacting the slide.

The main object of the present invention is to provide a lock which has a clutch mechanism to disengage the locking piece from the cam connected to the outer handle when the lock is locked.

Another object of the present invention is to provide a lock which allows the outer handle to be freely rotated when the lock is locked.

Further objects, advantages, and features of the present invention will become apparent from the following detailed description with appropriate reference to the accompanying drawings.

DETAILED DESCRIPTION OF THE PREFERRED EMBODIMENT

Figure 1:
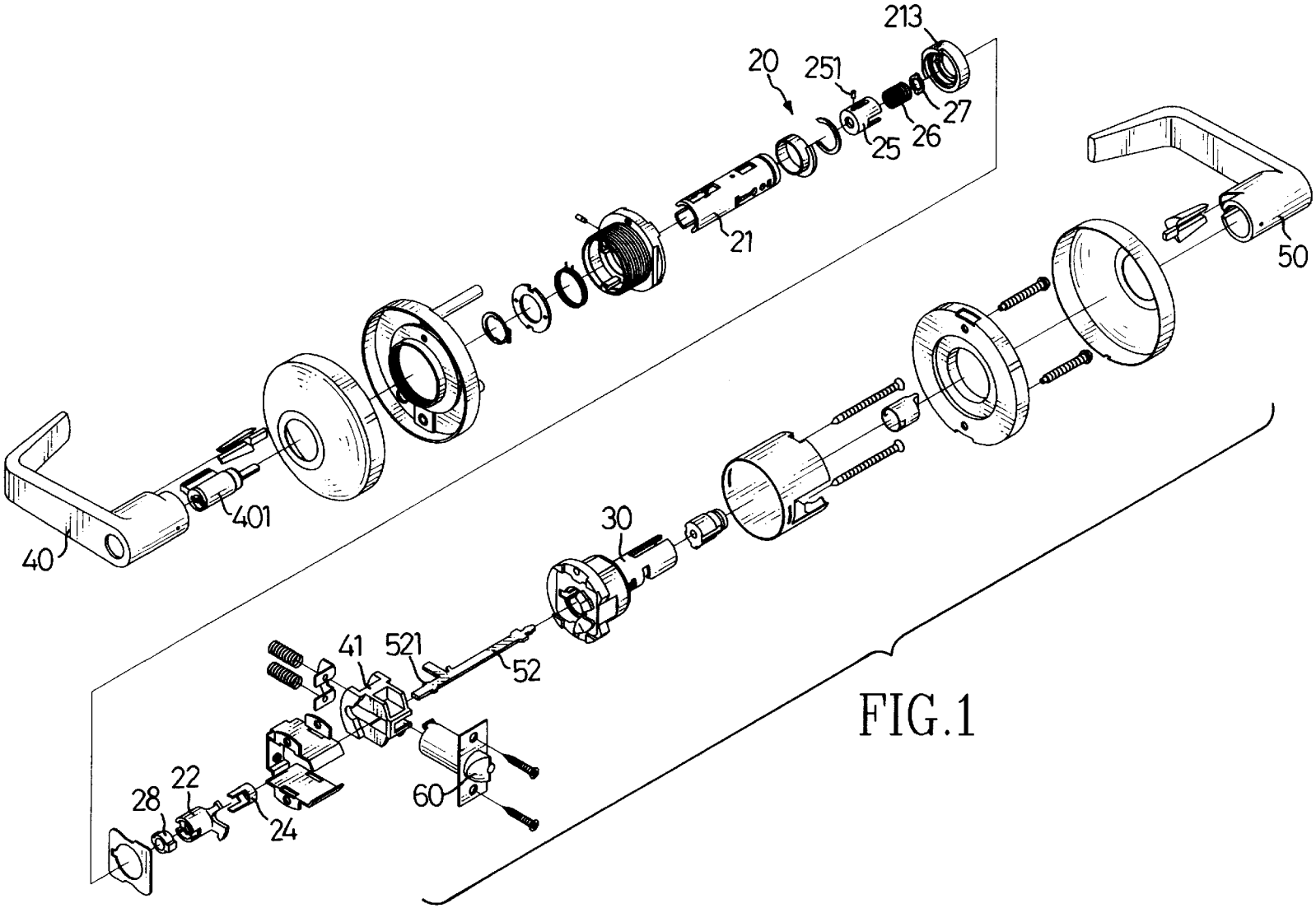
FIG. 1 is an exploded view of the lock in accordance with the present invention.
Figure 2:
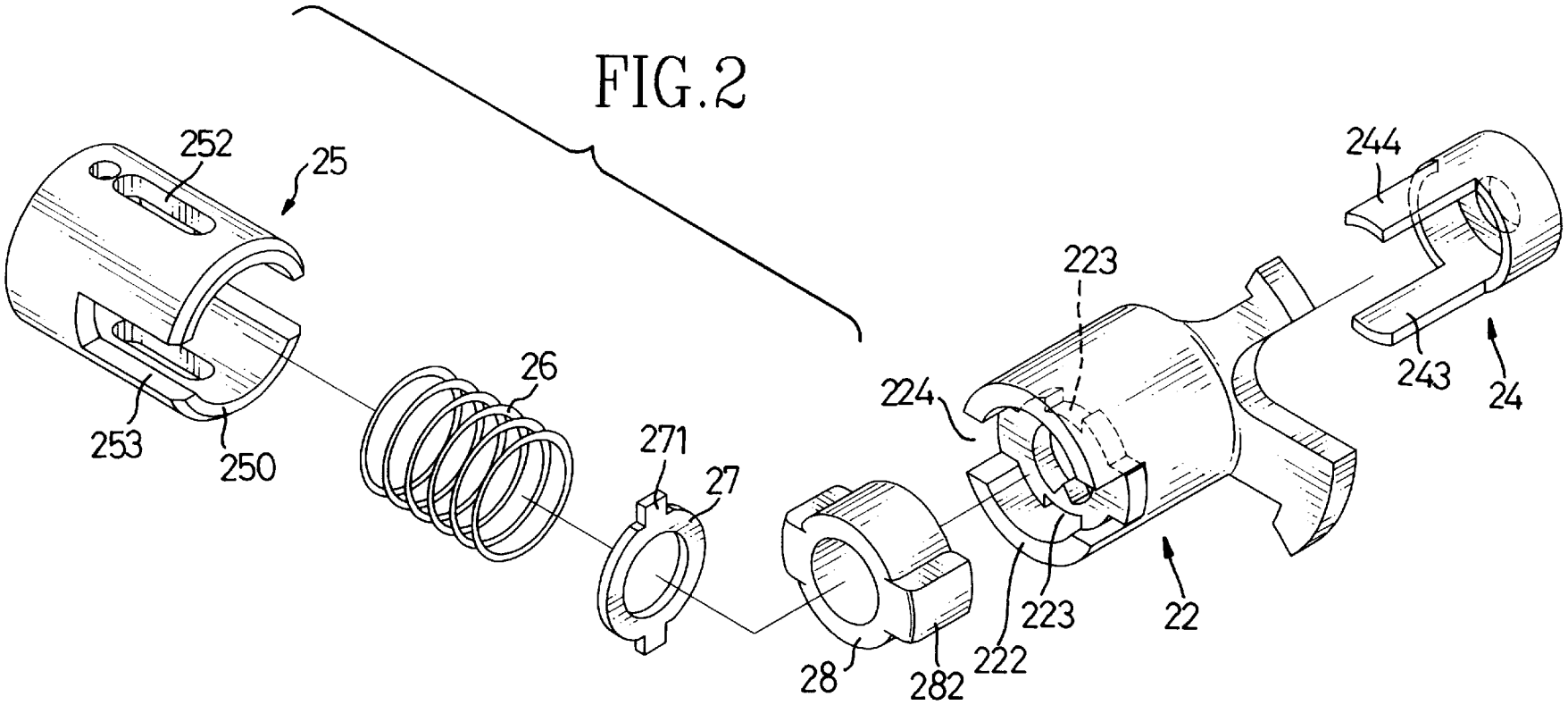
FIG. 2 is an exploded view of the clutch mechanism in accordance with the present invention.

Referring to FIGS. 1 to 4, the lock in accordance with the present invention comprises an outer handle (40) connected to a first spindle (21) in which tumbler cylinder (401) and a retaining base (25) are respectively received therein. The retaining base (25) is fixedly connected to the first spindle (21) by a pin (251) and has two first lugs (250) extending from one of two ends thereof so as to define two first grooves (253) between the two first lugs (250). A spring (26) is received in the first spindle (21) and located between the two first lugs (250) each of which has a first slot (252) defined therethrough. A ring-shaped retainer (27) is received between the two first lugs (250) and has two tongues (271) which are movably received in the two first slots (252).

A cam (22) has two second lugs (222) extending from one of two ends thereof so as to contact the two first lugs (250) and two second grooves (224) are respectively defined between the two second lugs (222). The two second grooves (224) communicate with the two first grooves (253). The cam (22) has two apertures (223, 223) respectively defined through the end having the two second lugs (222).

A slide (24) is movably received in the cam (25) and has two third lugs (243, 244) extending therefrom so as to extend through the two apertures (223, 223). A ring-shaped locking piece (28) is movably received between the two first lugs (250) and the two second lugs (222) and contacts the retainer (27). The locking piece (28) has two flanges (282) extending therefrom which are movably received in the first grooves (253) and the second grooves (224). The two third lugs (243, 244) of the slide (24) contact the locking piece (28).

An inner handle (50) has a second spindle (30) connected thereto through which a locking bar (52) movably extends. A retractor (41) is connected to the second spindle (30) and is mounted to the locking bar (52). The locking bar (52) has a protrusion (521) extending laterally therefrom and contacting the slide (24).

Figure 3:
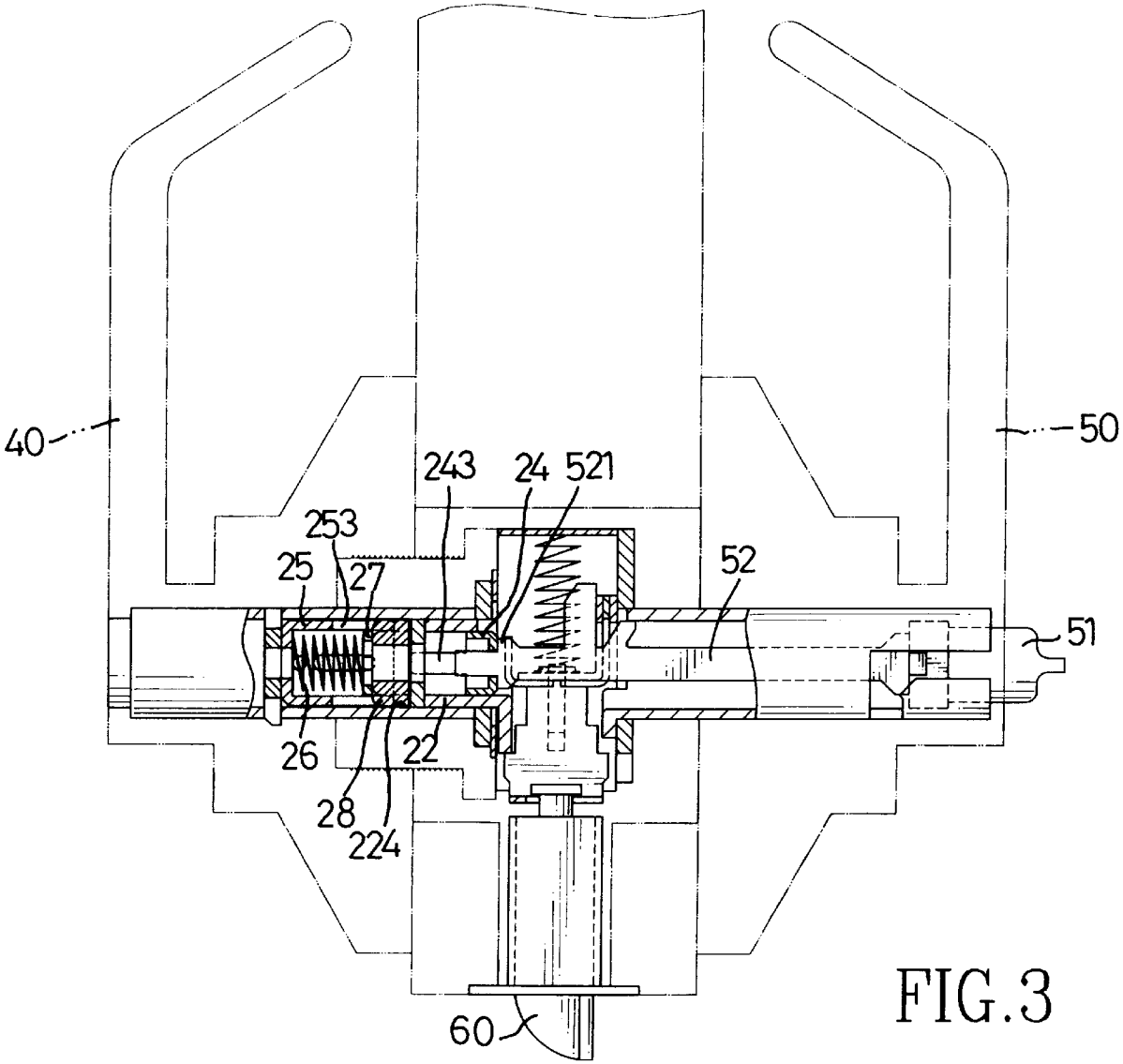
FIG. 3 is a side elevational view, partly in section, of the lock wherein the lock is in an open position.
Figure 4:
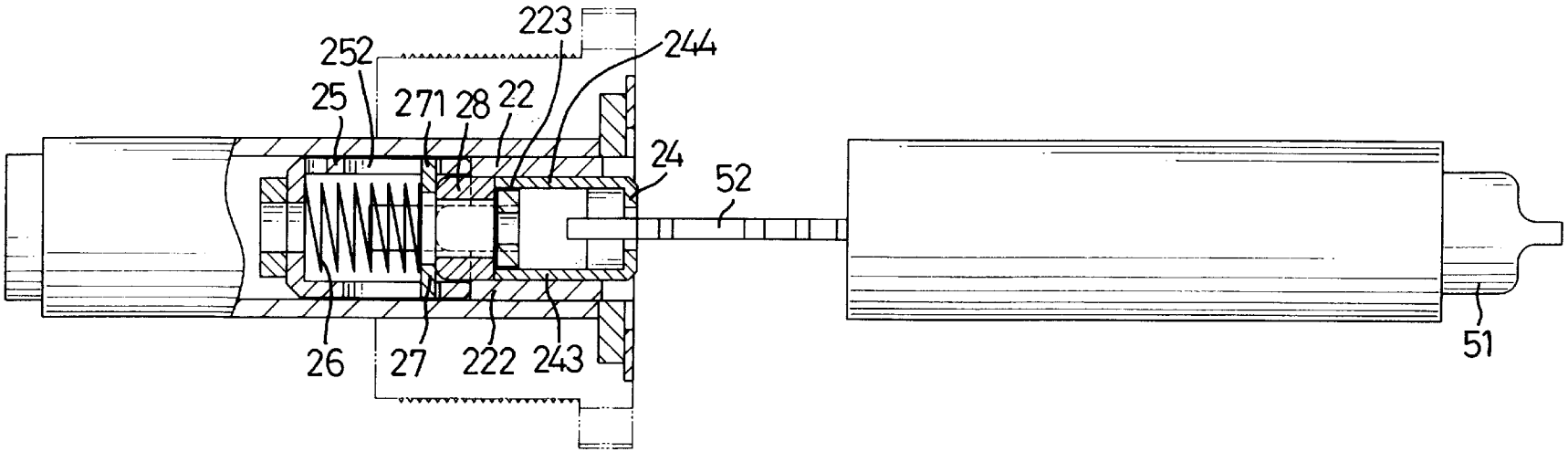
FIG. 4 is a top view, partly in section, to show the arrangement of the locking bar and clutch mechanism of the present invention.

It is to be noted that each first groove (253) has a length longer than that of each flange (282) of the locking piece (28) and each second groove (224) has a length shorter than that of each flange (282) of the locking piece (28) so that when the lock is in an opened position as shown in FIG. 3, the locking piece (28) is pushed by the spring (26) and each of the two flanges (282) is received partially in the first groove (253) and partially in the second groove (224). That is to say, when rotating either one of the inner handle (50) or the outer handle (40), the cam (22) is rotated to retract the latch bolt (60).

Figure 5:
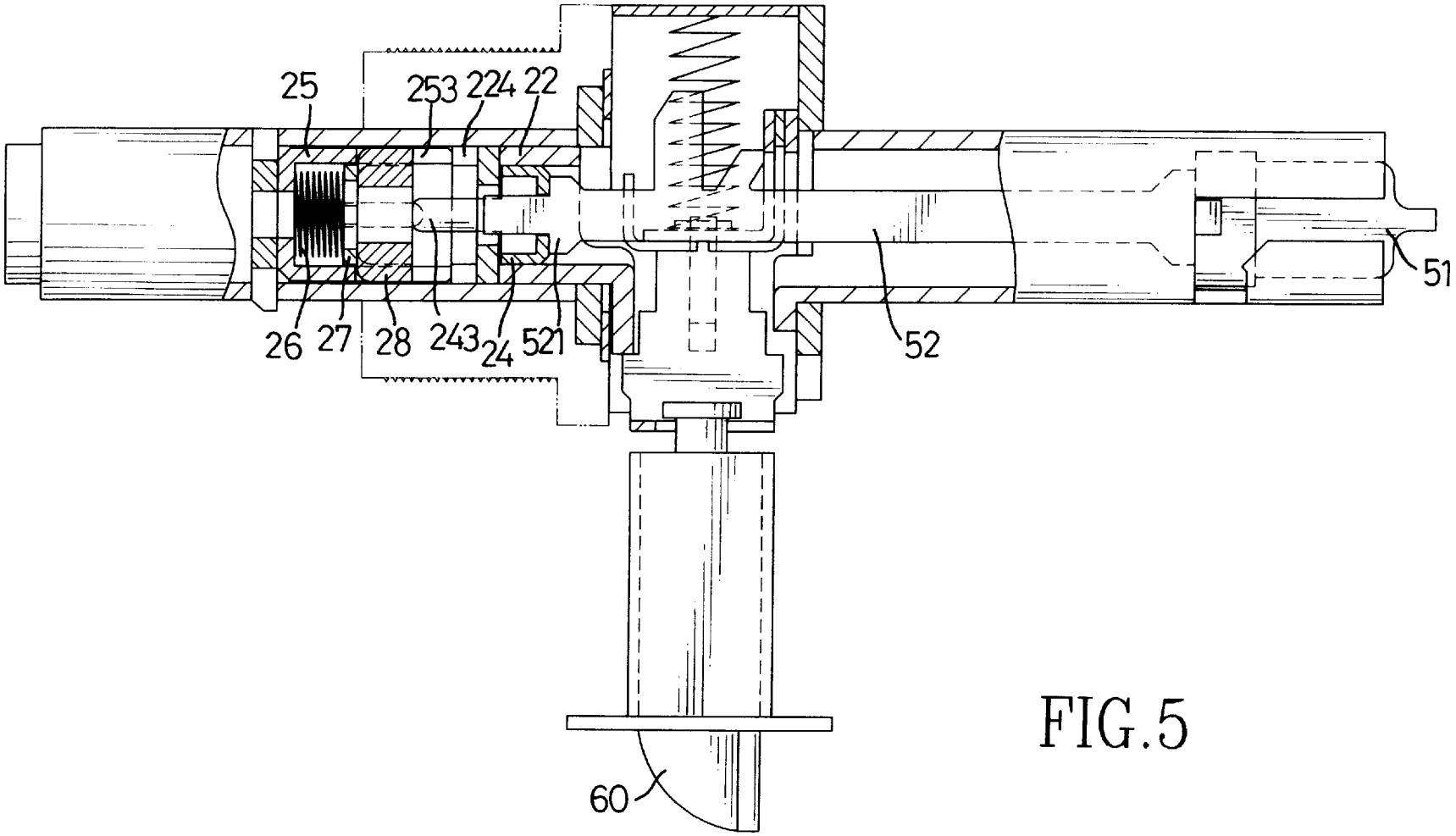
FIG. 5 is a side elevational view, partly in section, of the lock wherein the lock is in a locked position by pushing the locking bar.
Figure 6:
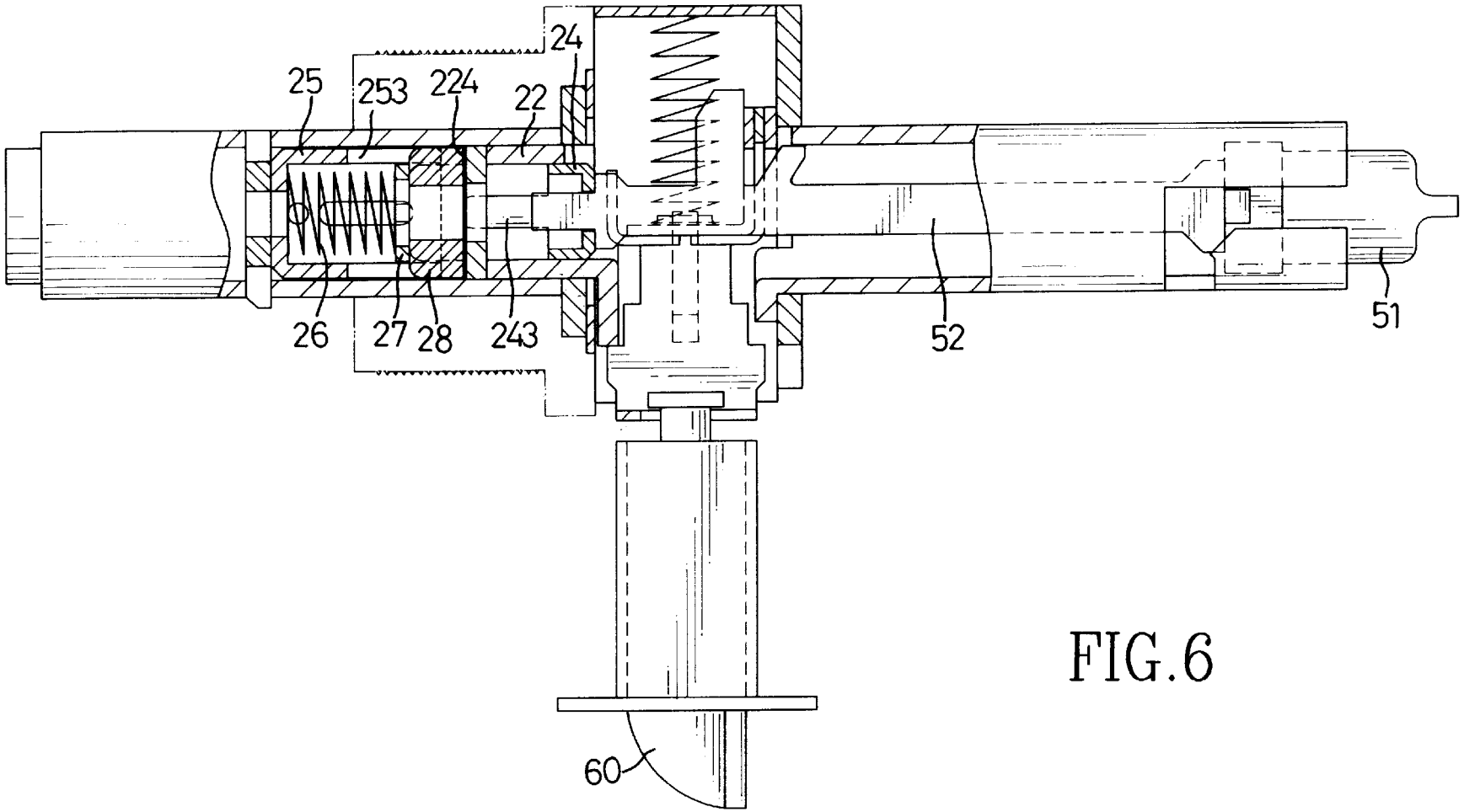
FIG. 6 is a side elevational view, partly in section, of the lock wherein the lock is in opened position.

Referring to FIG. 5, when the lock is in a locked position by pushing the push button (51) connected to the locking bar (52) and extending from the inner handle (50), the slide (24)

is pushed by the locking bar (52) and the locking piece (28) is therefore pushed and completely received in the two first grooves (253) and disengaged from the cam (22). Therefore, the outer handle (40) is freely rotatable without rotating the cam (22). Referring to FIG. 6, when the lock is unlocked, the locking bar (52) returns to its original position and the locking piece (28) and the slide (24) are pushed by the spring (26) so that each of the two flanges (282) is located in the first groove (253) and the second groove (224).

The combination of the retaining base (25), the spring (26), the retainer (27), the locking piece (28), the cam (22) and the slide (24) performs as a clutch mechanism to selectably disengage the locking piece (28) from the cam (22) when the locking bar (52) is pushed. By the invention, even if the outer handle (40) is applied a large torque, no internal parts will be actuated and the internal parts are therefore protected.

Although the invention has been explained in relation to its preferred embodiment, it is to be understood that many other possible modifications and variations can be made without departing from the spirit and scope of the invention as hereinafter claimed.

What is claimed is:

1. A lock comprising:

an outer handle (40) connected to a first spindle (21) in which a tumbler cylinder (401) and a retaining base (25) are respectively received therein, said retaining base (25) having two first lugs (250) extending from one of two ends thereof so as to define two first grooves (253) between said two first lugs (250);

a cam (22) having two second lugs (222) extending from one of two ends thereof so as to contact said two first lugs (250), two second grooves (224) respectively defined between said two second lugs (222) and communicating with said two first grooves (253), a slide (24) movably received in said cam (22);

a locking piece (28) movably received between said two first lugs (250) and said two second lugs (222) with a spring (26) biased between said locking piece (28) and said retaining base (25), said locking piece (28) having two flanges (282) extending therefrom and each of said two flanges (282) movably and partially received in said first groove (253) and said second groove (224) corresponding thereto, said slide (24) contacting said locking piece (28), and an inner handle (50) having a second spindle (30) connected thereto through which a locking bar (52) movably extends, a retractor (41) connected to said second spindle (30) and mounted to said locking bar (52), said locking bar (52) having a protrusion (521) contacting said slide (24).

2. The lock as claimed in claim 1, wherein each of said two first lugs (250) having a slot (252) defined therethrough and a retainer (27) is connected between said spring (26) and said locking piece (28), said retainer (27) having two tongues (271) extending therefrom and movably inserted into said two slots (252).

3. The lock as claimed in claim 1, wherein each first groove (253) has a length longer than that of each flange (282) of said locking piece (28) so that said locking piece (28) is completely received in said two first grooves (253) and disengaged from said cam (22) when said locking bar (52) is pushed to shift said slide (24).

4. The lock as claimed in claim 1, wherein each second groove (224) has a length shorter than that of each flange (282) of said locking piece (28).

5. The lock as claimed in claim 1, wherein said cam (22) has two apertures (223, 223) respectively defined through the end having said two second lugs (222) and said slide (24) has two third lugs (243, 244) extending therefrom so as to extend through said two apertures (223, 223) and contact said locking piece (28).

6. The lock as claimed in claim 2, wherein said retainer (27) is a ring-shaped member.

7. The lock as claimed in claim 1, wherein said retaining base (25) is fixedly connected to said first spindle (21) by a pin (251).

* * * * *